US005183111A

United States Patent [19]

Schellstede

[11] Patent Number: 5,183,111

[45] Date of Patent: Feb. 2, 1993

[54] EXTENDED REACH PENETRATING TOOL AND METHOD OF FORMING A RADIAL HOLE IN A WELL CASING

[76] Inventor: Herman J. Schellstede, P.O. Box 208, New Iberia, La. 70560

[21] Appl. No.: 747,348

[22] Filed: Aug. 20, 1991

[51] Int. Cl.[5] ..... E21B 43/112; E21B 7/18

[52] U.S. Cl. ..... 166/298; 166/55.2; 166/212; 166/223; 175/62; 175/67

[58] Field of Search ..... 166/55, 55.1, 55.2, 166/212, 222, 223, 297, 298; 175/62, 67

[56] References Cited

U.S. PATENT DOCUMENTS

| | | | |
|---|---|---|---|
| 1,962,961 | 6/1934 | Liedbeck | 166/55.2 |
| 2,066,409 | 1/1937 | Loring et al. | 166/55.2 |
| 2,381,929 | 8/1945 | Schlumberger | 166/55.1 |
| 4,640,362 | 2/1987 | Schellstede | 166/298 |

*Primary Examiner*—David J. Bagnell
*Attorney, Agent, or Firm*—Jacobson, Price Holman & Stern

[57] ABSTRACT

An extended reach penetrating tool which includes a tubing string lowered into a casing, anchored in position and including a cutting tool for forming a lateral hole in the casing. A formation penetrating tool is then substituted for the cutting tool on the tubing string and extended laterally through the hole in the casing and outwardly into the formation to a desired extent for enhancing production from the formation. The cutting tool for cutting a hole in the casing includes a laterally extendable cutting element urged radially from the tubing string by a piston and cylinder assembly with the cutting element in the preferred form being a rotatably driven cutting element which is extended radially from the tubing string into cutting engagement with the interior of the casing for forming a lateral opening. The formation penetrating tool is subsequently aligned with the opening in the casing and is in the form of a spiral tube that is moved through a guide structure and out through the hole in the casing for penetrating the formation as the spiral tube is unwound by a slowly rotating drive shaft to form a rigid lance having a nozzle on the end forming a lateral bore in the formation.

20 Claims, 4 Drawing Sheets

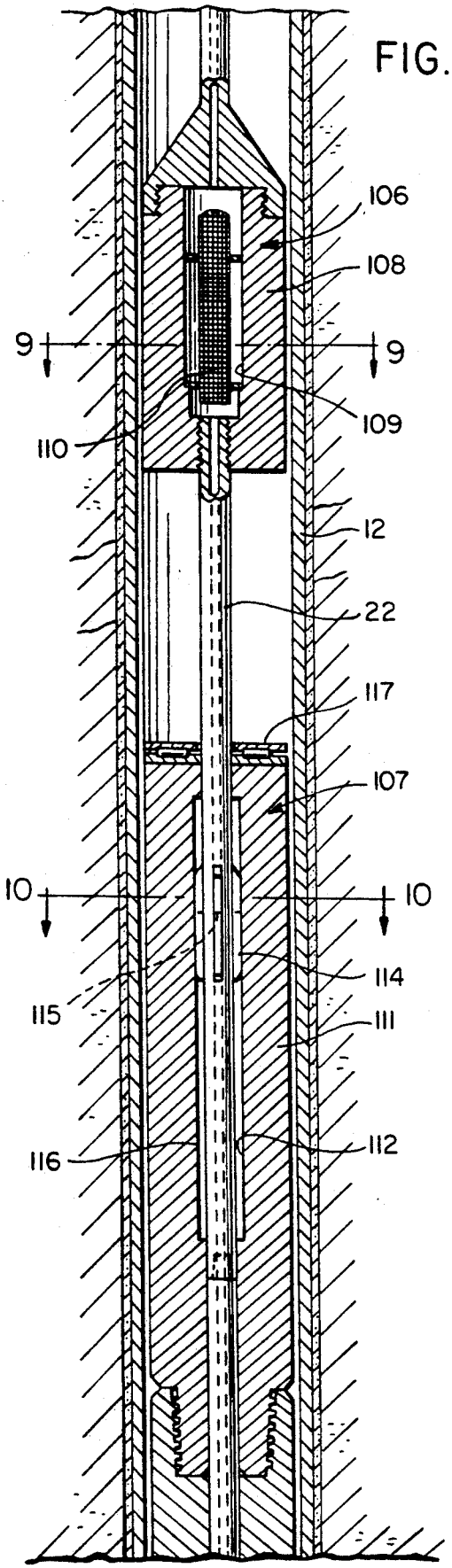
FIG. 8
FIG. 9
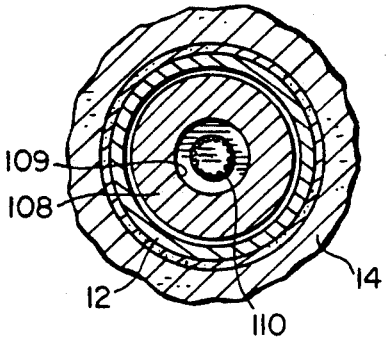
FIG. 10
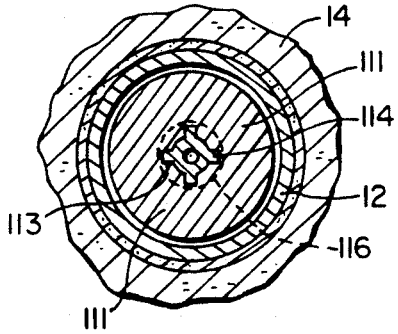
FIG. 11
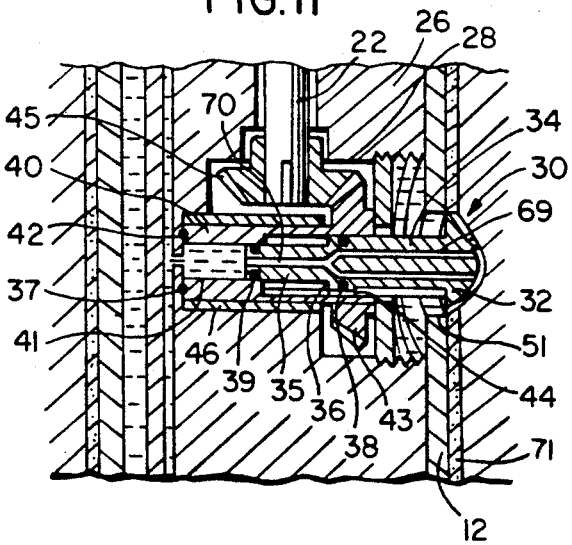
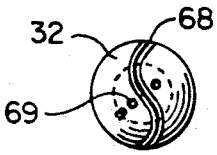
FIG. 12

EXTENDED REACH PENETRATING TOOL AND METHOD OF FORMING A RADIAL HOLE IN A WELL CASING

BACKGROUND OF THE INVENTION

1. Field of the Invention

The present invention generally relates to oil field equipment and more specifically an extended reach penetrating tool which includes a tubing string lowered into a casing, anchored in position and including a cutting tool for forming a lateral hole in the casing. A formation penetrating tool is then substituted for the cutting tool on the tubing string and extended laterally through the hole in the casing and outwardly into the formation to a desired extent for enhancing production from the formation. The cutting tool for cutting a hole in the casing includes a laterally extendable cutting element urged radially from the tubing string by a piston and cylinder assembly with the cutting element in the preferred form being a rotatably driven cutting element which is extended radially from the tubing string into cutting engagement with the interior of the casing for forming a lateral opening. The formation penetrating tool is subsequently aligned with the opening in the casing and is in the form of a spiral tube that is moved through a guide structure and out through the hole in the casing for penetrating the formation as the spiral tube is unwound by a slowly rotating drive shaft to form a rigid lance having a nozzle on the end forming a lateral bore in the formation.

2. Description of the Prior Art

Various efforts have been made to enhance the production of oil wells by treating, conditioning or otherwise endeavoring to stimulate fluid flow from the underground formation. Such efforts have included introduction of heated fluid, introduction of acids or solvents, introduction of wave energy, penetration of the formation, explosive cartridges, and the like. However, the prior art does not include an extendable reach penetrating tool in accordance with this invention and specifically does not include a structure for cutting a hole in the casing and extending a formation penetrating tool in the form of a rigid lance radially from the casing by extending the tool through the hole formed in the casing as disclosed in this application.

SUMMARY OF THE INVENTION

An object of the present invention is to provide an extended reach penetrating tool including a tubing string lowered into a casing with anchoring structure being provided for anchoring the tubing string at a desired position in the casing combined with a cutting tool which includes a cutting element to form a hole in the casing with a penetrating tool in the form of a rigid lance then being extended through the hole in the casing laterally into the formation for a predetermined distance.

Another object of the invention is to provide a penetrating tool in accordance with the preceding object in which the cutting tool includes a rotatable cutting element about a rotational axis perpendicular to the longitudinal axis of the tubing string with the cutting element being mechanically driven and radially extended by hydraulic fluid pressure associated with a piston and cylinder assembly connected with the rotatable shaft of the cutting element.

A further object of the invention is to provide a penetrating tool in accordance with the preceding object in which the tubing string includes anchor means extended by hydraulic pressure which also is communicated with the piston and cylinder arrangement for extending the rotatably driven cutting element.

Still another object of the invention is to provide a penetrating tool in accordance with the preceding objects which includes a spirally wound tube within a housing with the tube having an oval-shaped cross-section and being moved outwardly through the hole in the casing by which the penetrating tool can be radially extended as the spiral tube is unwound and forced outwardly through guiding and forming rollers into the formation as a rigid lance.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8 is a vertical sectional view of the clutch used in the tubing string.

FIG. 9 is a transverse sectional view taken along section line 9—9 on FIG. 7.

FIG. 10 is a transverse sectional view taken on section line 10—10 on FIG. 7 illustrating the clutch structure.

FIG. 11 is a detailed sectional view of the drive and extending and, retracting structure of the cutting element.

FIG. 12 is an end elevational view of the cutting element.

DESCRIPTION OF THE PREFERRED EMBODIMENT

Figure 1:
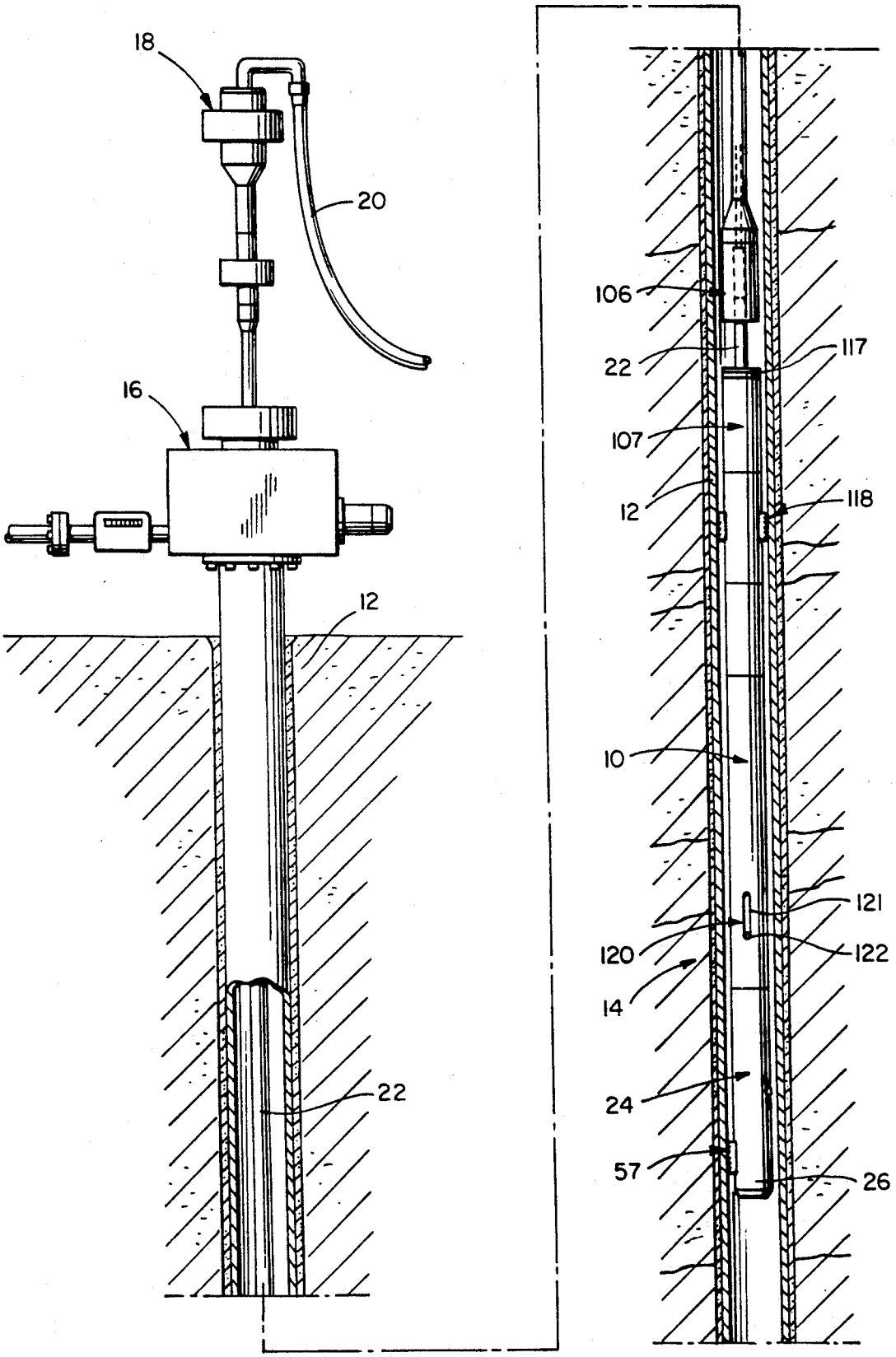
FIG. 1 is a schematic elevational view of the extended reach penetrating tool of the present invention illustrating a tubing string lowered into a well casing and anchored in position.

Referring now specifically to the drawings, FIG. 1 illustrates a tubing string 10 lowered into a well casing 12 forming a well extending downwardly into an underground formation 14 for producing fluid from that formation in a well known manner. The tubing string 10 incorporates the present invention therein and extends above ground surface into a turntable generally designated by reference numeral 16 with a swivel structure generally designated by numeral 18 being located above the turntable to supply pressurized fluid through a pipe or hose 20 into a hollow drive shaft 22 which extends into the tubing string 10. The turntable 16 drives the shaft 22 and enables the tubing string 10 to be run into and removed from the well in a well known manner.

The tubing string 10 includes a cutting tool 24 at the lower end thereof which includes an elongated cylindrical body 26 having a radially extending hollow cavity 28 near the center thereof with the cavity 28 including a cutter unit generally designated by reference numeral 30 which includes a rotatable and laterally adjustable cutting element 32 having a shaft 34 connected thereto. The shaft 34 includes a reduced end portion 35 defining differential area pistons 36 and 37 each of which includes an O-ring seal 38 and 39. The shaft 34 is reciprocally mounted in a rotatable shaft 40 having a hollow interior 41 forming a cylinder which receives shaft 34 and conforms in shape thereto. An O-ring seal 42 seals the end of hollow shaft 40 to the cavity 28. A bevel gear 43 is drivingly mounted on the shaft 40 and shaft 34 is drivingly connected to the shaft 40 by a sliding key 44 which enables the rotatable conical cutting element 32 to be driven by a bevel gear 45 mounted on the lower end of the drive shaft 22. The gear 45 is in meshing engagement with the gear 43 on the shaft 40 thus driving the rotary cutting element 32 in response to rotation of the shaft 22. A bushing 46 rotatably supports shaft 40 in the cavity 28 and a retainer 48 secures the mechanism in cavity 28. Fluid pressure enters the cavity 28 through an opening or orifice 49 and a passageway 50 for extending the cutting element 32 radially into engagement with the casing so that the cutter unit 30 forms a radially extending opening 51 in the casing 12.

The hollow shaft 22 is rotatably supported by a bronze bushing or similar structure 52 and a thrust roller bearing 53 and is sealed to the central bore in the housing 26 by O-ring seals 54. Between the O-ring seals 54, the longitudinal passageway 55 in the shaft 22 includes an opening or hole 56 in the hollow shaft which is in communication with the tubular passageway 50 which extends into communication with the inlet 49 and into communication with an anchor device 57 which includes a hydraulic piston 58 slidably received in a cylinder 59 with the piston 58 including an O-ring seal 60. The piston 58 includes piston rod 61 which has a compression spring 62 associated therewith and associated with a retainer 63 at the outer end of the cylinder 59. An anchor pad 64 mounted on piston rod 61 by bolt 65 is biased inwardly to retracted position illustrated in FIG. 2. The cylinder 59 is connected by an inlet 66 communicated with the passageway 50 thus admitting fluid pressure into the cylinder 59 and extending the anchor pad 64 into gripping engagement with the interior of the casing 12. The spring 62 will retract the anchor when fluid pressure is no longer exerted against the piston 58. The passageway 50 extends to the exterior of the body 26 below cylinder 59 and terminates in a jet orifice 67 which enables circulation of fluid pressure through passageway 50 with the orifice 67 controlling the discharge rate.

With this structure, the tubing string can be lowered to a desired elevational position with the cutting unit 30 in retracted position within the confines of the tubing string 10. The tubing string is then anchored by increase in pressure in the passageway 50. The cutting element 32 and shaft 34 are extended radially in relation to the shaft 40 and bevel gear 43 which is keyed thereto by longitudinal key 44. Rotation of the shaft 22 and bevel gear 45 will rotate the cutting element 32 with pressure exerted on the pistons 36 and 37 moving the cutting element 32 radially outwardly for forming a hole 51 in the casing 12.

Figure 3:
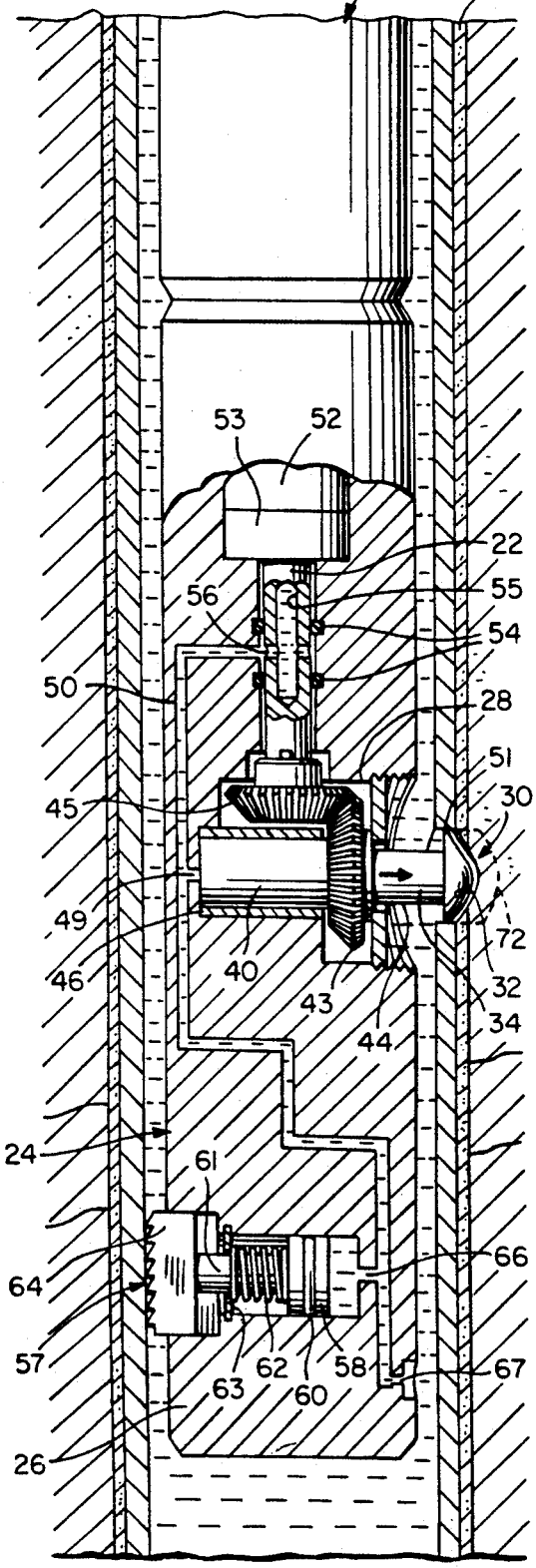
FIG. 3 is a sectional view similar to FIG. 2 but illustrating the cutting element extended to form a hole in the casing.

As illustrated the cutting element 32 has a cutting edge 68 which is of S-shaped configuration with the cutting element 32 including the cutting edge 68 being generally conical in configuration. The cutting element 32 and shaft 34 have a pair of longitudinal passageways 69 extending therethrough communicating with a single passageway 70 which extends through the end of the piston 37 and communicates with the fluid pressure entering through the entrance port 49. This fluid pressure is jetted through the passageways 69 and will facilitate forming a bore through the concrete 71 around the casing 12 and form a partial guide bore 72 in the formation 14 as illustrated in FIG. 3.

After the hole 51 has been formed in the casing and the fluid pressure jets worked through the concrete and starts a cavity or bore 72 in the formation, the fluid pressure is released and exhausted from the passageway 50 with static fluid pressure in the casing retracting the shaft 3 and cutting element and the spring 62 retracting the anchor pad 54. The cutting tool 24 along with the tubing string is removed from the casing and a penetrating tool generally designated by reference numeral 80 is placed on the tubing string 10 in place of the cutting tool 24 and the tubing string with the penetrating tool 80 is then lowered back into the casing 12.

As illustrated in FIGS. 4–7, the extended reach penetrating tool includes a tubular housing 81 made up into the tubing string 10 with the drive shaft 22 extending therethrough in rotatable relation. The lower end of the casing or housing 80 is provided with a solid body portion 83 having an anchor structure 84 incorporated therein with the solid body portion 83 being screw threaded to a solid lower end 85 on the casing 81 by a screw threaded connection 86.

Figure 4:
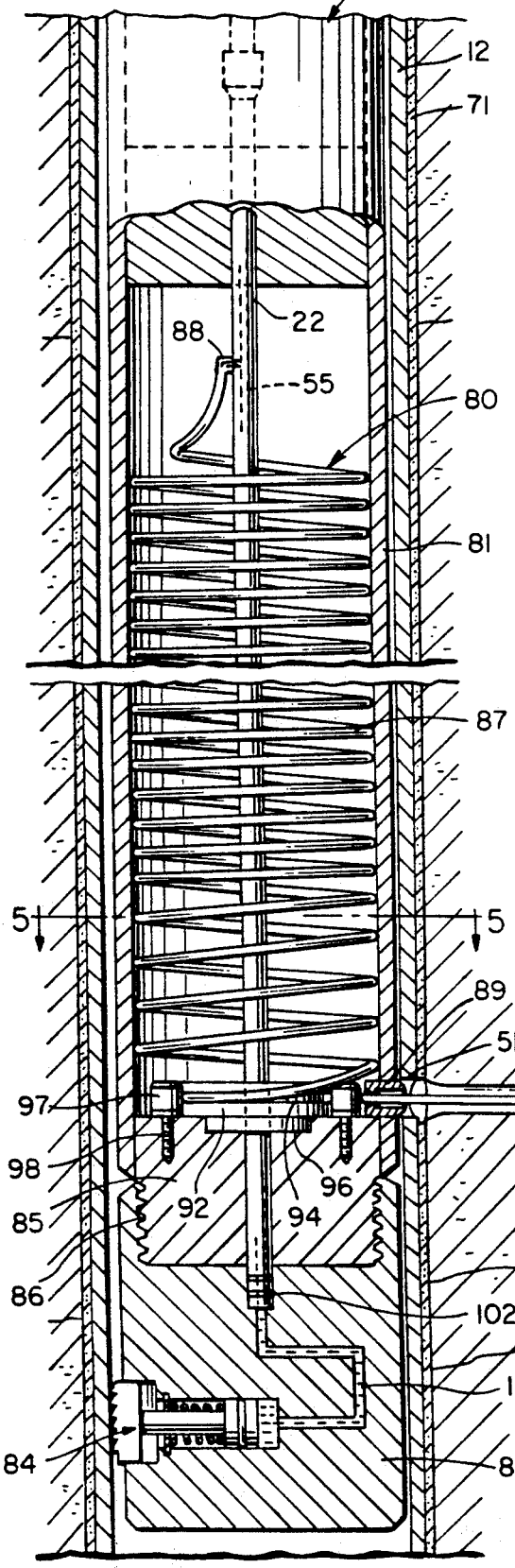
FIG. 4 is a vertical sectional view of the structure for extending and retracting the extended reach tool.
Figure 5:
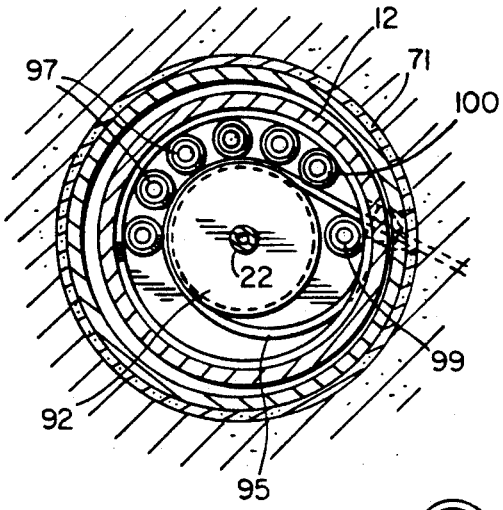
FIG. 5 is a transverse, sectional view taken substantially along section line 5—5 on FIG. 4.
Figure 7:
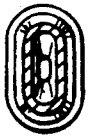
FIG. 7 is a transverse sectional view taken along section line 7—7 on FIG. 6.
Figure 6:
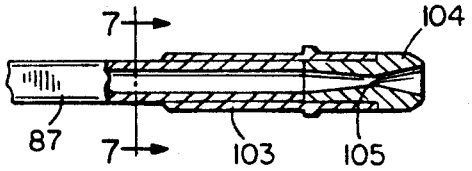
FIG. 6 is a detailed sectional view of the nozzle on the extended reach tool.

Positioned internally of the hollow casing 81 is a spiral tube 87 having its upper end extending inwardly and connected to the hollow passageway 55 in the rotatable drive shaft 22 by the use of a rigid fitting 88 which not only communicates the tube 87 with the passageway 55 but also serves to rotate the upper end of the spiral tube from the drive shaft 22. The lower end of the tube 87 extends laterally through a guide bushing 89 formed in the casing 80 with the terminal end of the tube including a jet nozzle 90 to form a bore 91 in the formation 14. The nozzle 90 is normally retracted within the confines of the guide bushing 89 when the penetrating tool 80 is lowered into the casing and the guide nozzle 89 aligned with the hole 51 in the casing 12. The lower end of the hollow interior of the housing 80 is provided with a centrally disposed roller 92 having a peripheral groove 94 therein which engages the interior surface of the bottom convolution of the spiral tube 84 along its inner surface as illustrated in FIG. 5 as the bottom convolution diverges from the other convolutions in the area indicated by reference numeral 95 in FIG. 5. The roller 92 is affixed to the drive shaft 22 for rotation therewith and is journaled in a recess 96 in the upper surface of the solid lower end 85 on the housing 80 as illustrated in FIG. 4. In opposed relation to a major portion of the periphery of the roller 82 is a plurality of guide and forming rollers 97 which are rotatably journaled and supported by a threaded axle or shaft 98 extending into the solid lower end 85 on the casing 80 as illustrated in FIG. 4. The relationship of the rollers 97 to the roller 92 is illustrated in FIG. 5 with the plurality of rollers 97 engaging the outer surface of the bottom most convolution 95 of the spiral tube 87 thus providing a frictional driving engagement between the driven large center roller 92 and the surface of the bottom most convolution 95 of the tube 87. A single roller 99 similar to the rollers 97 is located adjacent an edge of the guide nozzle 89 which cooperates with an adjacent spaced roller 100 which engages the lower most convolution 95 as it exits from contact with the roller 92. Thus, when the nozzle 90 is retracted into the guide bushing 89, the rollers 99 and 100 engage opposite surfaces thereof to enable the portion of the lower most convolution 95 extending between the periphery of the roller 92 and the guide nozzle 89 to remain straight even though compressive forces are exerted thereon as the tube 15 is extended through the guide nozzle 89 into the formation 14 to form the bore 91. The spiral tube 87 is constructed of a substantially rigid metal material and is of oval-shaped cross-sectional configuration as shown in FIG. 7 with the major axis disposed vertically. This provides a large area for fluid passage and provides for reduced force required to bend the tube in the minor axis direction. The oval-shaped lance, when pressurized, will tend to straighten thereby equalizing the forces and causing equilibrium in the member in a manner similar to a Bourdon tube in a pressure gauge. In order to obtain high nozzle tip pressure, frictional flow losses in the tube must be kept at a minimum which is obtained by the oval-shaped tube. Thus minimum force is required to straighten and rigidify the tube into a rigid lance with the vertical disposition of the major axis serving to retain the lance in a rigid horizontal orientation as it is formed into a straight, rigid lance and extended into the formation 14 to form a bore 91. The rotation of the roller 92 will cause the spiral tube, in effect, to unwind and extend into the formation to form a bore 91 of a predetermined length which may be in the order of several hundred feet. As the spiral tube 87 is fed through the guide nozzle 89, the convolutions of the tube 87 will be rotated due to the connection of the upper end of the tubing with the drive shaft 22 due to the rigid connection 88. Thus, the convolutions of the spiral tube 89 will spread apart longitudinally as the bottom most and adjacent convolutions are sequentially forced into the formation 14.

Figure 2:
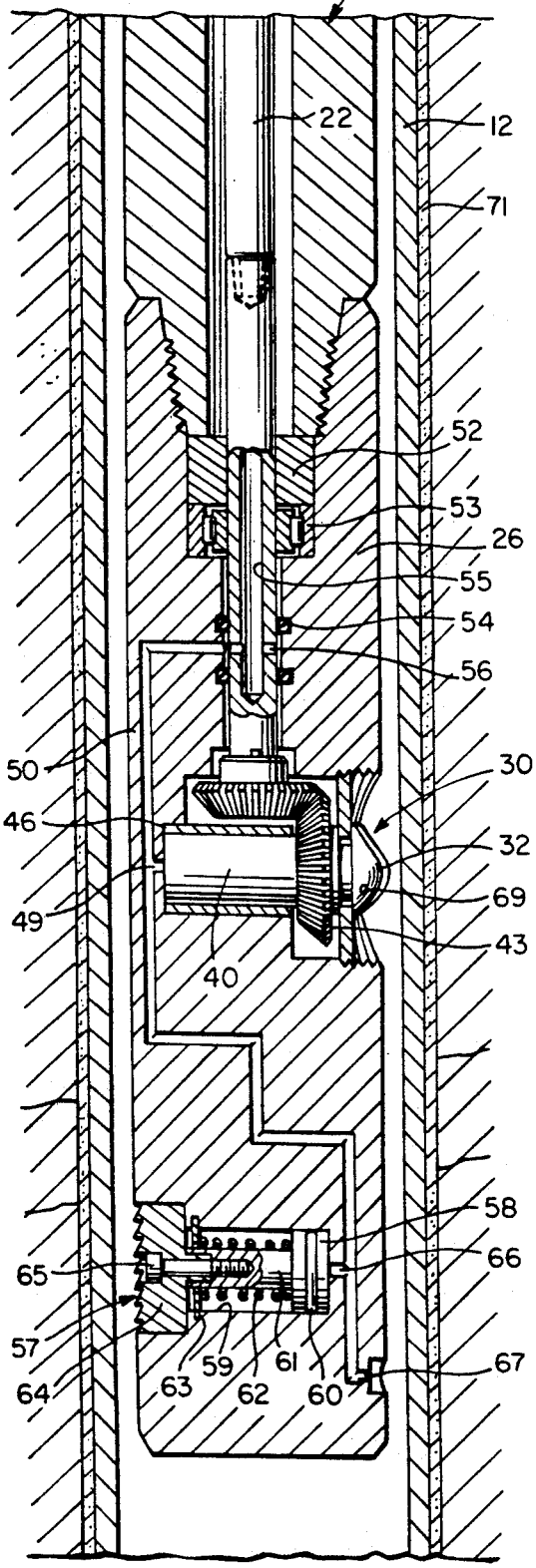
FIG. 2 is a vertical sectional view on an enlarged scale illustrating the structure of the cutting tool and lower anchor with the cutting element in retracted position.

The lower end of the drive shaft 22 is communicated with a passageway 101 in the solid member B3 with O-ring seals 102 sealing the rotatable connection between the drive shaft 22 and the stationary member 83 to supply pressurized fluid to the anchor device 84 which is identical device 57 as described in connection with FIG. 2 except that in this construction, there is no jet orifice discharge in the member 83.

The jet nozzle 80 includes a sleeve 103 connected to the end of the tube 87 with the tube 103 detachably receiving a nozzle member 104 having a restricted orifice 105 therein to provide an increase in velocity of the fluid pressure being supplied through the drive shaft 22 to enable the formation to be penetrated to a desired extent with the diameter of the bore 91 being somewhat larger than the size of the nozzle 90.

FIGS. 8-10 illustrate additional details of the tubing string including a filter generally designated by reference numeral 106 and a clutch structure generally designated by reference numeral 107. The filter 106 includes a tubular housing 108 having a hollow interior 109 with the hollow drive shaft 22 being drivingly connected to and communicated with the upper and lower ends of the housing 108. The interior of the housing includes a cylindrical filter screen 110 which is supported in spaced relation to the interior 109 in a manner to cause the fluid to flow through the filter screen in a conventional and well known manner to provide a source of clean pressurized fluid for operating the cutting tool 24 and operating the penetrating tool 80.

Positioned below the filter is the clutch 107 which connects the drive shaft 22 to the tubing string when the tubing string is being lowered into the casing 12 with the clutch subsequently disconnecting the drive connection to the tubing string when it is anchored thus enabling the drive shaft 22 to drive the cutting tool and penetrating tool. The clutch 107 includes a housing 111 having a hollow interior area 112 with the upper portion of the interior 112 including a plurality of peripherally arranged grooves and ribs 113 for meshing and driving engagement with a plurality of ribs and grooves 114 on the drive shaft 22. Thus, as long as the housing 111 is suspended or supported from the drive shaft 22, the housing 111 is in its lower position with the grooves and ribs 113 on the interior of the upper end portion of the hollow portion 112 drivingly connected with the ribs and grooves 114 on the exterior of the drive shaft 22. However, when the tubing string is anchored to the casing 12 and the drive shaft and filter are lowered from the surface, the ribs and grooves 114 on the drive shaft 22 will move downwardly to disengage from the bottom ends 115 of the grooves and ribs 113 so that the ribs 114 on the drive shaft are registered with a lower cylindrical portion 116 of the hollow interior 112 of the housing 111. The upper end of the housing 111 is provided with a bearing structure which rotatably supports the lower end of the housing 108 for the filter 106 when the filter and drive shaft 22 are lowered to disengage the clutch 107. As illustrated in FIG. 1, the tubing string includes a hook wall anchor sub 118 below the clutch 107 which is a conventional anchor structure for anchoring the tubing string at a desired elevation. Positioned below the conventional hook wall anchor 118 the tubing string 10 includes a lost motion connection 120 in the form of longitudinal slots 121 and a pin 122 received in the diametrically opposed slots to limit the downward movement of the clutch assembly to approximately 12". This enables the tubing string to be rotated when run into the well casing or when removed therefrom when the tubing string is suspended or supported from the drive shaft 22 with the driving connection between the drive shaft 22 and the tubing string being disconnected by the clutch when the tubing string has been anchored and the drive shaft 22 moved downwardly in relation to the tubing string by virtue of the lost motion connection 120 with the clutch 107 disconnecting the drive shaft from the tubing string and the tubing string then being supported by the bearing assembly 117 on the top of the clutch 107 by engagement of the lower end of the filter housing with the bearing assembly 117.

In operation, the tubing string is made up in a conventional manner and lowered into the well casing by following well known techniques with the turntable rotatably driving the power shaft with the entire assembly being rotatably driven while being run into the well casing or removed therefrom after completion of the operation. After the tubing string has been lowered to the desired elevation and oriented in the desired angular relation to the well casing, the tubing string is anchored by the hook wall anchor structure and the anchor at the lower end of the cutting tool. The drive shaft is then lowered to disengage the clutch and fluid pressure in the drive shaft is increased to extend the cutting element into engagement with the casing wall with the cutting element being rotated from the drive shaft by the bevel gear and sliding keyed shaft arrangement. The cutting operation is completed with the cutting element forming the hole 51 in the casing and the jets and cutting element working in unison to form the hole and also form a hole through any concrete outwardly of the casing and form a partial hole into the formation to serve as a guide for the penetrating tool. After the hole has been formed in the casing, pressure is reduced in the drive shaft with the static head pressure in the casing and reduction of fluid pressure in the drive shaft releasing the bottom anchor and returning the cutting element to its retracted position. The drive shaft is then elevated to reengage the clutch and the hook wall anchor released and the tubing string with the cutting tool 24 thereon is pulled out of the well casing in a conventional manner and the penetrating tool substituted for the cutting tool and tubing string with the penetrating tool thereon is then run into the casing with a feeler being provided to align the guide nozzle and jet nozzle on the lower end of the spiral tube with the hole in the casing with the anchors then being set and the drive shaft lowered approximately 12" to disengage the clutch. The drive shaft then extends the rigid coil spring steel tube through the hole 51 by forming it into a straight, rigid lance having the jet nozzle on the outer end thereof for forming the bore into the formation by high pressure fluid injected through the jet nozzle on the end of the rigid lance. After the bore in the formation has been formed, the drive shaft is reversed to retract the tubing back through the hole 51 with the jet nozzle received in the guide bushing. The drive shaft is then elevated to engage the clutch and the tubing string anchors are released to enable rotation of the tubing string when it is pulled out of the well.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A tool for forming a hole in a well casing comprising a tubing string for insertion into a well casing, anchor means for securing the tubing string in place, a rotatable drive shaft extending into the tubing string with the shaft being hollow for communication with a source of pressurized fluid, said tubing string including a cutting tool made up into the tubing string, said cutting tool including a body having a radial cavity formed therein in communication with the surface of the body, a cutting element drivingly connected to said shaft and positioned in said cavity within the confines of the exterior surface of the body when in retracted position, fluid pressure operated means for extending said cutting element radially from the cavity into engagement with the casing for cutting a hole in the casing with said means extending the cutting element also including means for retracting the cutting element when the hole has been formed in the casing.

2. The tool as defined in claim 1 together with an extender tool made up into the tubing string in lieu of the cutting tool, said extender tool including a spirally wound tube within the tubing string and having a formation penetrating tool on one end thereof, said tube extending laterally outwardly through the opening in the casing and moved therethrough as well as a rigid lance when the spiral tube is slowly unwound and guided through the casing hole, said spiral tube being connected to the drive shaft for extending and retracting the tube and formation penetrating tool.

3. The tool as defined in claim 2 wherein the formation penetrating tool on the end of the spirally wound tube is a jet nozzle, said extender tool including a tubular housing receiving the spirally wound tube with the upper end of the spirally wound tube being connected to the drive shaft and communicating with the source of pressurized fluid in the hollow drive shaft for rotating the upper end of the spiral tube and communicating fluid pressure with the spiral tube.

4. The tool as defined in claim 3 wherein the lower end of the housing including means for gripping and driving engagement with the lower most convolution of the spiral tube to project the jet nozzle and lower convolutions of the spiral tube through a guide structure in said housing and through the hole in the casing into the formation, said tube having an oval-shaped cross-sectional configuration with the major axis disposed vertically to provide maximum flow area with minimum flow resistance, reduce the force required to bend the tube in the minor axis direction and maximum resistance to vertical deflection.

5. The tool as defined in claim 4 wherein said means drivingly engaged with the bottom most convolution of the spiral tube includes an internal roller drivingly connected to the drive shaft and rotatably journaled in the housing, said roller including a groove in the peripheral surface receiving and engaging the internal surface of a portion of the lower most convolution of the spiral tube and a plurality of idler rollers mounted on the housing in opposed relation to the grooved roller and engaging the outer surface of the lower most convolution of the spiral tube to grippingly engage and move the spiral tube outwardly of the housing while forming it into a straight, rigid lance having the formation penetrating tool on the end thereof.

6. The tool as defined in claim 5 wherein said housing includes a guide bushing for guiding and receiving the spiral tube as it is extended into the formation and retracted therefrom, additional guide rollers engaging opposed surfaces of the lower most convolution of the tube as it approaches the guide bushing.

7. The tool as defined in claim 6 wherein said cutting element is a rotatable cutter mounted on a shaft, a pair of bevel gears within said cavity with one bevel gear being rigidly attached to the drive shaft and the other bevel gear slidably and drivingly connected with the cutting element for rotating the cutting element as it is extended, said cutting element including a shaft forming a piston received in a cylinder formed in said cavity with the cylinder being in communication with a fluid pressure passageway in said body for extending the rotatable shaft and cutting element thereon to form a hole in the casing.

8. The tool as defined in claim 7 wherein said shaft of the cutting element forming a piston includes a reduced end portion defining two pistons having differential areas with the cylinder being correspondingly shaped, said cylinder being in the form of a hollow rotating shaft receiving the cutting element shaft and being keyed thereto by a sliding key arrangement, said other bevel gear being rigidly affixed to said shaft having the cylinder formed therein.

9. The tool as defined in claim 1 wherein said anchor means for tubing string includes a radially extendable anchor member, fluid pressure operated means extending said anchor member into engagement with the casing and spring means returning the anchor to a retracted position.

10. The tool as defined in claim 1 wherein said cutting element is a rotatable cutter mounted on a shaft, a pair of bevel gears within said cavity with one bevel gear being rigidly attached to the drive shaft and the other bevel gear slidably and drivingly connected with the cutting element for rotating the cutting element as it is extended, said cutting element including a shaft forming a piston received in a cylinder formed in said cavity with the cylinder being in communication with a fluid pressure passageway in said body for extending the rotatably shaft and cutting element thereon to form a hole in the casing.

11. The tool as defined in claim 10 wherein said shaft of the cutting element forming a piston includes a reduced end portion defining two pistons having differential areas with the cylinder being correspondingly shaped, said cylinder being in the form of a hollow rotating shaft receiving the cutting element shaft and being keyed thereto by a sliding key arrangement, said other bevel gear being rigidly affixed to said shaft having the cylinder formed therein.

12. The tool as defined in claim 11 wherein said cutting element is generally conical in configuration and provided with an S-shaped cutting edge thereon, and jet passages in said cutting element and shaft communicating with the source of pressure fluid to extend the cutting element to assist in forming a guide bore in the formation and concrete exterior of the casing.

13. The tool as defined in claim 12 wherein said anchor means for the tubing string includes a radially extendable anchor member, fluid pressure operated means extending said anchor member into engagement with the casing and spring means returning the anchor to a retracted position.

14. The tool as defined in claim 13 wherein said tubing string includes a discharge jet orifice in the lower end portion thereof communicating with the fluid pressure operating means to enable circulation of fluid to the fluid pressure operated means.

15. The tool as defined in claim 14 together with a filter assembly at the upper end of said tubing string and a clutch disposed below the filter assembly for drivingly connecting the tubular string to the drive shaft when the tubular string is suspended from the drive shaft to enable the tubular string to be rotated when running the tubular string into the well casing and disengaging the drive shaft from the tubular string after the tubular shaft has been anchored thus enabling the drive shaft to be rotated independently of the tubing string to mechanically drive said cutting element.

16. The tool as defined in claim 1 together with a turntable mounted at the upper end of said casing for rotatably driving said shaft and a swivel oriented above the turntable with the swivel including means communicating the drive shaft with a source of pressurized fluid.

17. The method of forming a radial hole in the casing of a well which extends into an underground formation consisting of the steps of lowering a tubing string into a well casing, anchoring the tubing string at a predetermined position in the well casing, extending a cutting element from the tubing string into engagement with the well casing while actuating the cutting element to form a hole in the casing and subsequently extending a formation penetrating tool from the tubing string through the hole in the casing into the formation to form a bore in the formation in a generally horizontal direction form the hole in the casing and retracting the penetrating tool and removing the tubular string from the casing to enhance production of fluid from the formation into the casing.

18. The method as defined in claim 17 wherein said step of actuating the cutting element includes a step of rotating a laterally extendable cutting element as it is extended laterally from the tubing string by connecting the cutting element mechanically to a drive shaft extending into the tubular string.

19. The method as defined in claim 18 wherein the step of extending a penetrating tool into the formation include the step of drivingly engaging the lower most convolution of a spiral tube within the tubing string and extending it outwardly therefrom through the hole in the casing, communicating the spiral tube with a source of pressurized fluid through a drive shaft connected with the spiral tube and discharging pressurized fluid from a jet nozzle on the end of the spiral tube to form a bore in the formation.

20. The method as defined in claim 17 wherein the step of extending a penetrating tool into the formation includes the steps of drivingly engaging the lower most convolution of a spiral tube within the tubing string and extending it outwardly therefrom through the hole in the casing, communicating the spiral tube with a source of pressurized fluid through a drive shaft connected with the spiral tube and discharging pressurized fluid from a jet nozzle on the end of the spiral tube to form a bore in the formation.

* * * * *